US006039598A

United States Patent [19]

Ciavarella

[11] Patent Number: 6,039,598

[45] Date of Patent: Mar. 21, 2000

[54] ELECTRIC EQUIPMENT INTERCONNECTION

[75] Inventor: Nicholas Ciavarella, Cleveland, Ohio

[73] Assignee: MTD Products Inc., Cleveland, Ohio

[21] Appl. No.: 09/013,155

[22] Filed: Jan. 26, 1998

[51] Int. Cl.[7] ..... H01R 13/58

[52] U.S. Cl. ..... 439/451; 439/540.1; 439/367

[58] Field of Search ..... 439/458, 367, 439/540.1, 373, 451, 452

[56] References Cited

U.S. PATENT DOCUMENTS

| | | | |
|---|---|---|---|
| 4,610,494 | 9/1986 | Schauber | 439/369 |
| 5,549,482 | 8/1996 | Langlais et al. | 439/373 |
| 5,593,312 | 1/1997 | McCracken | 439/369 |
| 5,885,098 | 3/1999 | Witkowski | 439/369 |

*Primary Examiner*—Paula Bradley
*Assistant Examiner*—Katrina Davis
*Attorney, Agent, or Firm*—Emerson & Associates; Roger D. Emerson; Timothy D. Bennett

[57] ABSTRACT

An improved interconnection for use with electric power equipment, and more particularly with electric power rotary lawn mowers, is disclosed. The interconnection includes a connection apparatus that has a loop that slides over a rod that extends between the two handle bars of the lawn mower. The connection apparatus also includes an access slot for receiving a looped portion of an extension cord and a tab for releasably connecting the extension cord to the connection apparatus. The connection apparatus allows the power cord and extension cord to freely move back and forth along the rod between the two tubes of the lawn mowers handle bars. In an alternate embodiment, the rod 50 may have an extended W-shaped to provide a greater distance along which the connection apparatus may move.

20 Claims, 3 Drawing Sheets

ELECTRIC EQUIPMENT INTERCONNECTION

BACKGROUND OF THE INVENTION

1. Field of Invention

This invention relates to an improved interconnection for use with electric powered equipment, more particularly in the preferred embodiment an electric powered rotary lawn mower.

2. Description of the Related Art

Electric lawn and garden equipment-like mowers are coming into increasing utilization as environment, noise, and other types of government controls are coming into existence. Further, as technology advances, these units can be made smaller and lighter than in the past. In addition to the above, there is also the matter that some consumers prefer electric powered devices for their ease of maintenance, lack of noise, and other perceived advantages over their gasoline powered counterparts.

One distinct disadvantage of electric power devices is the extension cord which interconnects them to the source of power; typically a long extension cord leads back to the operator's house. This cord is a source of certain annoying properties, most particularly that it can hinder the operator. For this reason, a number of ways have been developed to interconnect the extension cord to the device so as to automatically position the extension cord out of the operator's way. An example of this is to have a loop or special part located between the extension cord and the handle bar tubes of the device—thus interconnecting the extension cord to the device as well as providing some sort of stationery, or side-to-side moving displacement means to locate the extension cord out of the operator's way. These devices typically require a multiplicity of parts and, in addition, are not always successful in the positioning extension cord out of the operator's way and/or preventing separation of the interconnection between the extension cord and the power cord for the device.

SUMMARY OF THE INVENTION

This object of present invention is to increase the usability of electric powered lawn mowers.

It is yet another object of the invention to improve the interconnection between the extension cord and an electric powered lawn and garden care appliance.

It is yet another object of the invention to simply the mode of interconnection between an extension cord and an electric lawn mower.

Other objects and a more complete understanding of the invention may be had by referring the following description and drawings in which:

BRIEF DESCRIPTION OF THE DRAWINGS

The structure, operation, and design of the invention would become apparent on consideration of the following description of the preferred embodiment invention taken in conjunction with the accompanying drawings in which.

DESCRIPTION OF THE PREFERRED EMBODIMENT

Figure 1:
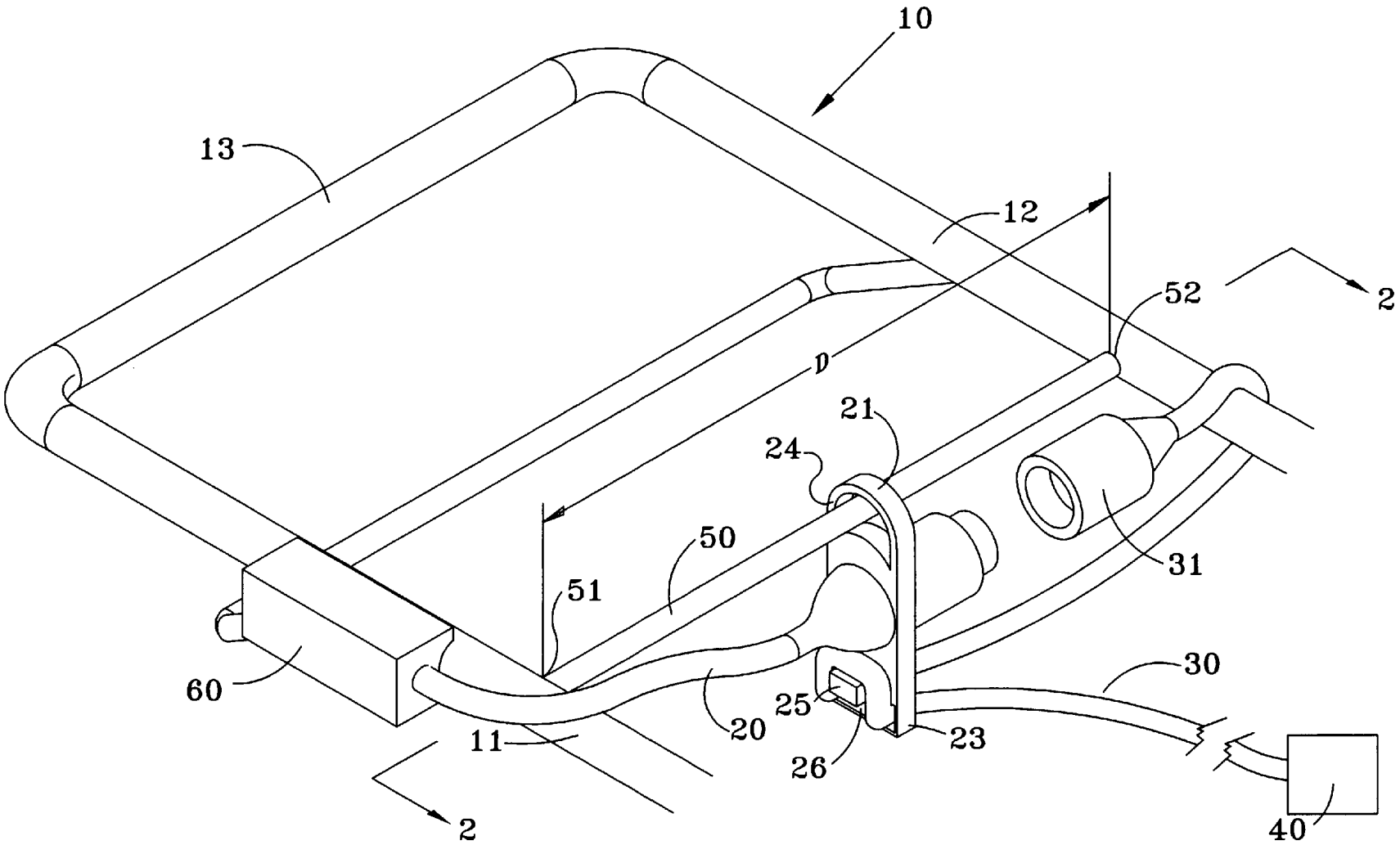
FIG. 1 is a front side perspective view of the handle bars of an electric lawn and garden care appliance incorporating the present invention.

This invention relates to an improvement for electric lawn and garden care appliances.

The invention will be described in a preferred embodiment utilized with an electric rotary lawn mower such as the 12 amp 19 inch rear bagging MTD Lawn Mower Model 387, a 20 inch dedicated mulcher model 097, or the 19 inch side discharge model 427. Other appliances could be substituted.

Figure 2:
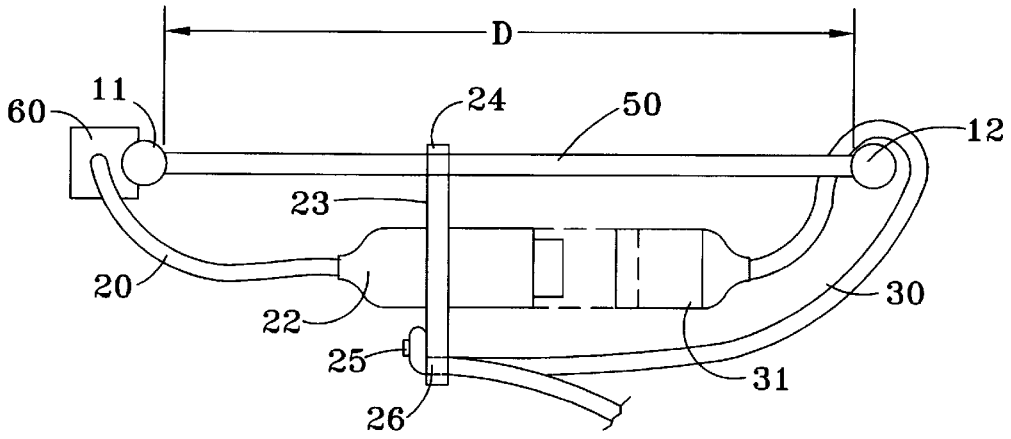
FIG. 2 is a diagram of the embodiment of FIG. 1 taken along lines 2—2 in FIG. 1 and disclosing the critical distances in respect thereto.

These MTD rotary lawn mowers have a main driven electric motor powering a rotary cutting blade underneath a stamped steel mower deck (all not shown). As shown in FIGS. 1 and 2, the lawn mowers, in addition, include a generally U-shaped tubular handle bar 10 extending rearwards off of the back part of the mower deck in a conventional manner. This handle bar 10 includes two substantially parallel handle bar tubes 11,12 lying in a single plane so as to form the main direction control for the lawn mower. It also typically serves to mount operational controls such as electric switches, etc.

The particular lawn and garden care appliance disclosed includes two substantially 0.50 inch diameter handle bar tubes 11,12 extending parallel to each other approximately 18 inches apart, the handle bar tubes 11,12 being joined by an integral laterally extending handle section 13 in the customary manner.

The mower itself disclosed includes a power cord 20 of a relatively short length formed with a integral connection member 21 on an end thereof and a switch 60 on its other end. The switch 60 is fixedly mounted to one of the handle bar tubes 11 in a manner similar to the foregoing mentioned MTD mowers. In alternate embodiments this latter end of the power cord 20 could terminate elsewhere (for example at the motor housing).

In the particular embodiment disclosed, the power cord 20 has a male plug 22 formed integrally therewith at its loose end. In that the particular unit disclosed is for use in Europe, the male plug 22 is formed with a two plug, 230 volt DIN type plug interconnection. With differing types of electrical powered equipment and/or different nationalities, the length of the power cord 20 and the nature of the connection member could be varied appropriately.

The extension cord 30 is typically interconnected to the device for providing electric current to the device from a stationery source of power 40. In the certain prior devices, this interconnection has been accomplished by wrapping the extension cord 30 around a separate interconnection member, which interconnection member can shift from side to side in respect to the handle bars tubes 11,12 of the device in order to connect the extension cord 30 to the garden appliance handle bar tubes 11,12. This would be true whether the extension cord 30 is integral with the power cord 20 or separate.

In the invention of the present application, there is a connection means 23 associated with the power cord 20 for selectively interconnecting the extension cord 30 to such power cord 20. In the preferred embodiment, this connection means 23 is formed integrally with the male plug 22 at the end of such power cord 20. Further, in the preferred embodiment there is also a loop 24 formed into the male plug 22 for slidingly interconnecting the entire assembly to the cord control rod 50 which extends between the two handle bar tubes 11,12 a spaced distance from the handle section 13 of such handle bar assembly.

Figure 4:
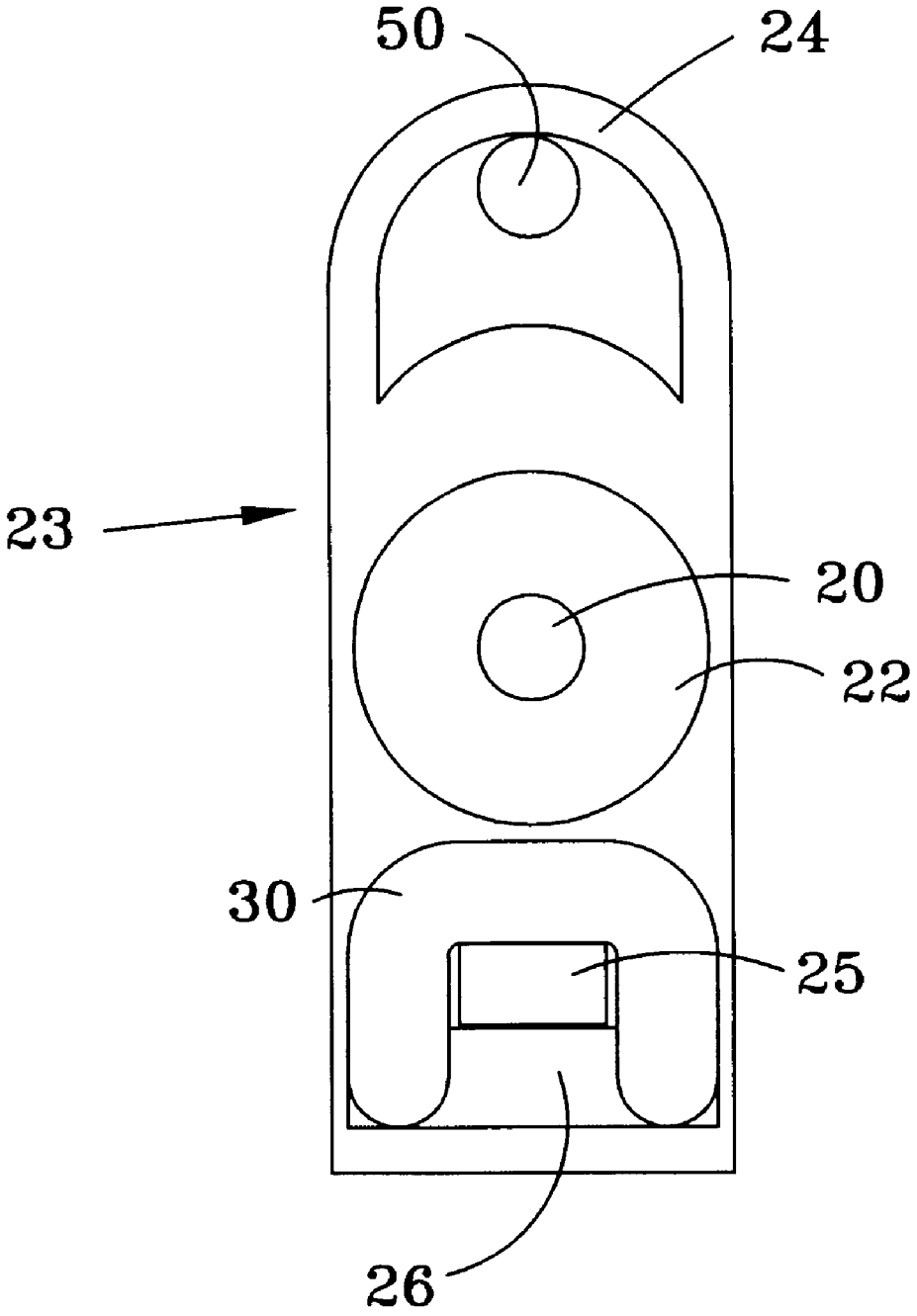
FIG. 4 is an end view of the connection means of FIG. 1 taken generally along lines 4–4 in FIG. 2.

As shown in FIG. 4, the particular connection means 23 disclosed in the preferred embodiment is a combination of a horizontally extending tab 25 in combination with a access slot 26. To operate this connection means, the user forms a loop in the extension cord 30 a spaced distance from its end and pushes the loop through the access slot 26. When a sufficient amount of loop has been passed through, the user flips the protruding section of the U-shaped loop over the tab 25 and gently begins retracting the extension cord 30. This action locks the extension cord 30 over the tab 25, and thus firmly but releasably connects it to the connection means 23. Other types of orientations and locations of tabs 25 and access slots 26 could also be used with the invention.

In this respect, it is noted that the two handle bar tubes 11,12 of the handle bar 10 are spaced apart by a certain distance D, in the particular embodiment disclosed by about 18 inches. In that power cord 20 has an end fixed to the handle bars 11 (by the switch 60), it is preferred that the length of the power cord 20 from the effective end of the cord (at 21) is such that the loop 24 is free to travel down the full length of the control rod between the opposing ends 51, 52 thereof before any separation forces are placed on its interconnection with the power switch 60 (or alternate fixed mounting location). For example, in the embodiment disclosed, the forces are placed on the power cord's interconnection with the switch 60. Since the connection means 23 and loop 24 are both integral with the male plug 22 at the extreme end of the power cord 20, this would mean that the length of the power cord 20 between the switch 60 and the male plug 22 is equal to or greater than the full length of the control rod (or about 22 inches in this example see FIG. 2). With this distance orientation, the loop 24 will be free to travel between the handle bar tubes 11,12 while not placing any separation force between the male plug 22 and the female socket 31 at the end of the extension cord 30 or on the switch 60. Further, the mass of the combination of the connection means 23, the male plug 22, the loop 24, and the female socket 31 assists in the sideward movement of the assembly by creating a large mass to exist at this point. Further, the connection means 23 provides for a strain relief between the parts of the lawn mower and any forces on the extension cord 30. This is particularly important if the long runs of extension cord are being utilized.

Figure 3:
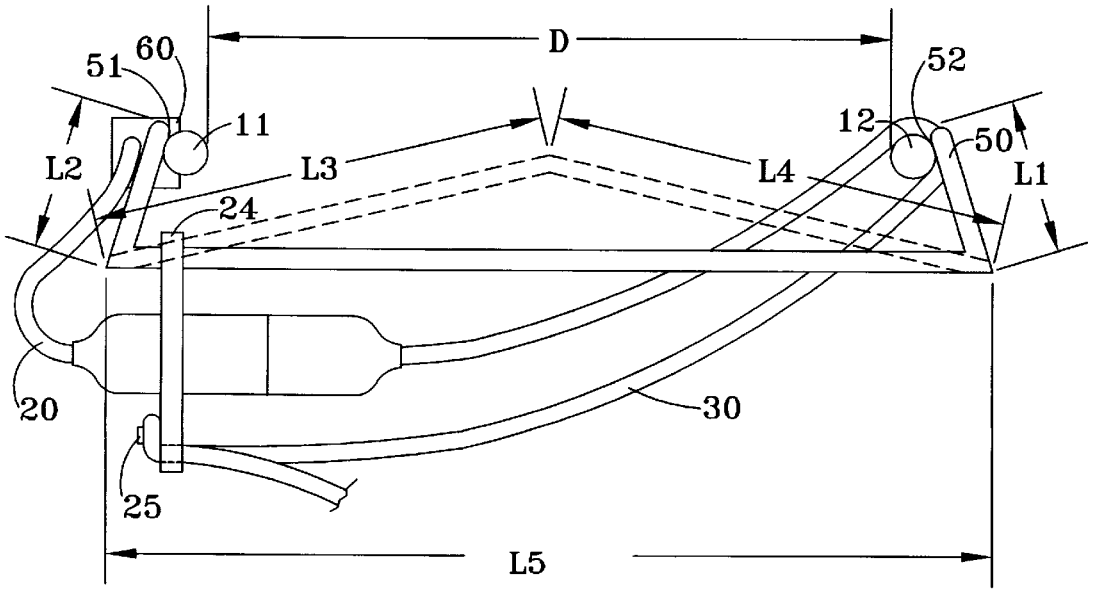
FIG. 3 is an alternate embodiment of a control rod configuration taken along line 2—2 of FIG. 1.

It should be noted that the length of the power cord 20 may have to be varied according to the particular application. For example, as shown in FIG. 3, the "w" shaped cord control rod 50 is shown to be utilized with the invention, which control rod 50 has ends which are located outside of the handle bar tubes 11,12. The inclusion of this type of control rod 50 increases the effective length L of the control rod 50. This length L is equal to the sum of all of the sub-lengths of the control rod 50. For instance, in the "w" shaped embodiment shown in FIG. 3, the length L is equal to the sum of L1, L2, L3 and L4. And, in the "u" shaped embodiment shown in FIG. 3, the length L is equal to the sum of L1, L2 and L5. This allows use of narrower handle bars while keeping the extension cord 30 out of the operators path. In any type of control rod 50, displacement of the center higher than the two ends (as shown in dotted line in FIG. 3) will slightly add to the usability of the device by biasing the loop 24 outwards of the center of the device, thus retaining the loop at the ends of the control rod 50 for a longer period than would otherwise occur.

Although the invention has been described in its preferred mode to a certain degree of particularity, it is to be understood that numerous changes can be made without deviating from the invention as hereinafter claimed.

I claim:

1. An electric apparatus comprising:

a deck;

first (11) and second (12) handle bars extending from said deck;

a rod (50) operatively connected to said first and second handle bars;

a power receiver adapted to receive power through an associated extension cord plugged into an external source of power; and, a connection member fixedly connected to said power receiver for use in connecting said power receiver to the associated extension cord, said connection member comprising:

a body;

a first opening in said body for slidingly receiving said rod, said connection member thereby being slidable along said rod;

a second opening in said body adapted to selectively receive a loop of the associated extension cord; and, a tab over which the loop of the associated extension cord may be looped, said tab protruding from said body.

2. The apparatus of claim 1 wherein said first opening is located above said tab.

3. The apparatus of claim 1 wherein said first opening is located above said second opening.

4. The apparatus of claim 1 wherein said power receiver comprises:

a plug for plugging the electric apparatus into the associated extension cord, the connection member further comprising:

a third opening for fixedly connecting said plug to the connection member.

5. The apparatus of claim 4 wherein said rod (50) has a length L and said first (11) and second (12) handle bars are separated by a distance D that is less than or equal to said length L.

6. The apparatus of claim 5 wherein said power receiver has a power cord having a first end connected to said plug, said power cord having a length that is greater than or equal to said distance D such that said connection member is slidable along the entire length L of said rod (50).

7. The apparatus of claim 6 wherein said first and second handle bars lie within a plane and a portion of said rod does not lie within said plane.

8. The apparatus of claim 1 further comprising:

a switch for selectively switching power to the apparatus, said switch being operatively connected to said power receiver.

9. A apparatus of claim 8, wherein said electric apparatus is a mower comprising:

a cutting blade operatively associated with said deck; and, a motor for use in rotating said cutting blade.

10. The apparatus of claim 9 wherein said power cord has a second end operatively connected to said motor.

11. The apparatus of claim 1 wherein said connection member hangs from said rod and is substantially perpendicular to the ground while being slidable along said rod.

12. The apparatus of claim 11 wherein said tab is substantially perpendicular to said body of said connection member.

13. Connection member for use in connecting an associated electric apparatus to an external source of power comprising:

a body;

a first opening in said body, said first opening adapted to slidingly receive a member of the associated electric apparatus, said connection member thereby being slidable along the member of the associated electric apparatus;

a second opening in said body adapted to selectively receive a loop of an associated extension cord plugged into an external source of power; and, a tab over which the loop of the associated extension cord may be looped, said tab protruding from said body.

14. The connection member of claim 13 wherein said first opening is located above said second opening.

15. The connection member of claim 13 wherein said first opening is located above said tab.

16. The connection member of claim 13 wherein the associated electric apparatus has a plug for plugging the electric apparatus into the associated extension cord, the connection member further comprising:

a third opening for fixedly connecting said plug to the connection member.

17. A method of connecting an electric apparatus to a source of external power comprising the steps of:

providing an electric apparatus that has a power receiver for receiving power and a member;

providing a connection member that has a first opening for slidingly receiving the member of the apparatus, a second opening and a tab;

sliding the connection member onto the member of the apparatus;

providing an extension cord that is plugged into an external source of power;

forming a loop in the extension cord;

threading the loop of the extension cord through the second opening;

looping the loop over the tab; and, connecting the power receiver to the extension cord.

18. The method of claim 17 wherein the apparatus has at least one handle bar, immediately before the step of connecting the power receiver to the extension cord, the method further comprising the step of:

winding the extension cord around a handle bar of the apparatus.

19. The method of claim 17 wherein the power receiver comprises a plug for plugging the electric apparatus into the extension cord, the step of connecting the power receiver to the extension cord comprising the step of:

plugging the plug into the extension cord.

20. The method of claim 19 wherein the connection member comprises a third opening for fixedly connecting the plug to the connection member, immediately after the step of sliding the connection member onto the member of the apparatus, the method further comprising the step of:

connecting the plug into the third opening.

* * * * *